United States Patent [19]

Moe

[11] 4,091,704

[45] May 30, 1978

[54] SOUND CHAMBER AND TRANSDUCER APPARATUS FOR USE WITH HARMONICA

[76] Inventor: LeRoy Howard Moe, 4 Woodland Ct., Lombard, Ill. 60148

[21] Appl. No.: 762,625

[22] Filed: Jan. 26, 1977

[51] Int. Cl.[2] ..... G10D 7/12

[52] U.S. Cl. ..... 84/378; 84/1.04

[58] Field of Search ..... 84/1.04, 377, 378, 379

[56] References Cited

U.S. PATENT DOCUMENTS

| | | | |
|---|---|---|---|
| 2,565,100 | 8/1951 | Tate | 84/1.04 X |
| 2,664,775 | 1/1954 | Zielinski | 84/377 X |
| 2,945,408 | 7/1960 | Terlinde | 84/378 X |
| 3,322,875 | 5/1967 | Roll et al. | 84/1.04 X |

FOREIGN PATENT DOCUMENTS

| | | | |
|---|---|---|---|
| 965,138 | 9/1950 | France | 84/377 |
| 497,104 | 8/1954 | Italy | 84/1.04 |

*Primary Examiner*—Lawrence R. Franklin

[57] ABSTRACT

An apparatus for use with a reed-type harmonica includes a sound chamber having a convex central portion and a pair of outer edge portions which are formed for engaging the harmonica metal extensions. A transducer assembly includes a microphone pick-up attached to a flange at one end of the main chamber member. A sound input director element extends from the transducer assembly into the chamber, and includes a tapered portion at the end farther from the microphone pick-up.

4 Claims, 7 Drawing Figures

SOUND CHAMBER AND TRANSDUCER APPARATUS FOR USE WITH HARMONICA

BACKGROUND OF THE INVENTION

Various devices have been proposed for use with an ordinary reed-type harmonica to amplify sound output level. Some of the proposed devices have proved unwieldy, being much larger than the harmonica itself and thus not susceptible of easy handling. Others have proved dangerous, with the use of some appreciable voltage applied to the harmonica or the pick-up unit, in an area only inches from the mouth of the user. Still others have proved unduly expensive because of their precise tailoring to only one model of a harmonica.

It is thus a primary object of the present invention to provide a sound chamber apparatus for use with a harmonica, which apparatus is relatively small and easily mounted to the harmonica.

Another important object is to provide such an apparatus with no significant voltages applied to the chamber or the pick-up device.

It is another important object of this invention to provide such an apparatus which is readily removable and can be easily mounted on a great variety on those harmonicas presently marketed.

Another significant object of the present invention is to provide such an apparatus which has improved sound quality as compared with known sound chamber devices.

An important object of the invention is to provide such an apparatus which in no way interferes with a normal handling and operation of the harmonica.

SUMMARY OF THE INVENTION

A sound chamber and transducer apparatus constructed in accordance with this invention is particularly useful with the reed-type harmonica having metal plates extending above and below, and slightly to the rear of the harmonica body. Normally the extremities of these plates are turned at substantially right angles to provide a flange or angle portion virtually parallel with the solid back of the harmonica body.

The apparatus of the invention includes a chamber member extending substantially the same length of the harmonica body. The chamber has a convex or fluted central portion, and its outer edge portions are rolled or formed to engage the flanges along the metal plates of the harmonica itself. An attaching portion, such as a flange, of the chamber member is provided at one end and extends at substantially right angles to the chamber member itself. A transducer assembly includes a body portion affixed to the flange of the chamber member, and supports a transducer element such as a microphone pick-up unit within the body of the transducer assembly.

In accordance with an important aspect of the invention, a generally cylindrical sound input director element is provided within the chamber-transducer combination. This director element has a portion which extends into the chamber defined adjacent the back of the harmonica body, and this extremity is tapered at an angle. The other end of the director element extends to the transducer assembly body, being open adjacent the transducer or microphone element, and thus serves to conduct sound vibrations from the chamber to a point where the vibrations can be converted into an electrical signal for translation to associated equipment, such as amplifying apparatus.

THE DRAWING

In the several figures of the drawing, like reference numerals identify like components, and in the drawing.

DETAILED DESCRIPTION OF THE INVENTION

Figure 1:
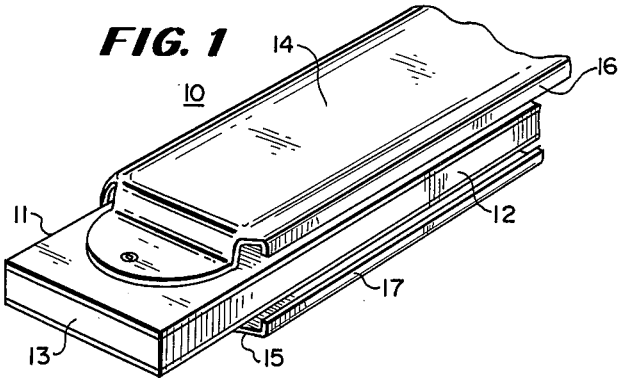
FIG. 1 is a perspective view of the conventional harmonica, depicting the flanges at the ends of the upper and lower metal plates.

FIG. 1 shows one end portion of a conventional harmonica 10. The front portion 11 is that into which the user blows his breath, and the rear portion 12 is generally solid as is the one end portion 13 visible in FIG. 1. The reed structure within the harmonica is not visible in this showing, but the two metal plates 14 and 15 above and below the harmonica help to define sound egress channels for directing the sound outwardly and to the rear of the harmonica. The upper plate 14 has an extremity turned downwardly into a flange or edge portion 16 extending substantially flush or parallel with the back portion 12 of the harmonica, and a similar flange 17 is provided at the extremity of the lower plate 15. This flange formation at the extremities of the plates is conventional for most harmonicas presently marketed.

Figure 3:
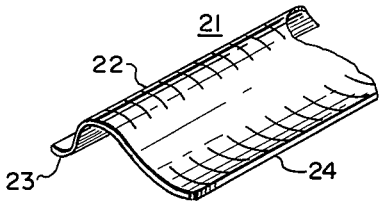
FIG. 3 is a perspective illustration of a portion of the sound chamber member of the invention.
Figure 2:
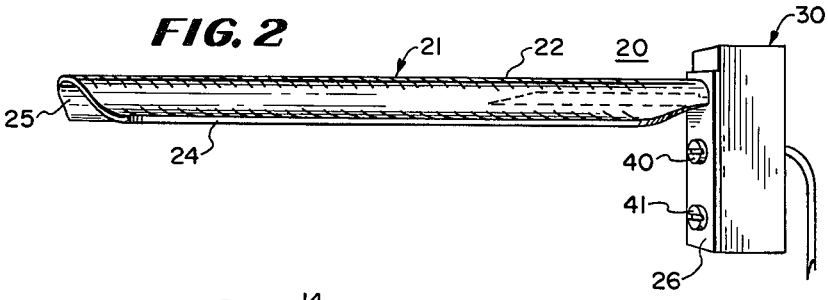
FIG. 2 is a perspective illustration of the sound chamber and transducer apparatus of this invention.
Figure 4:
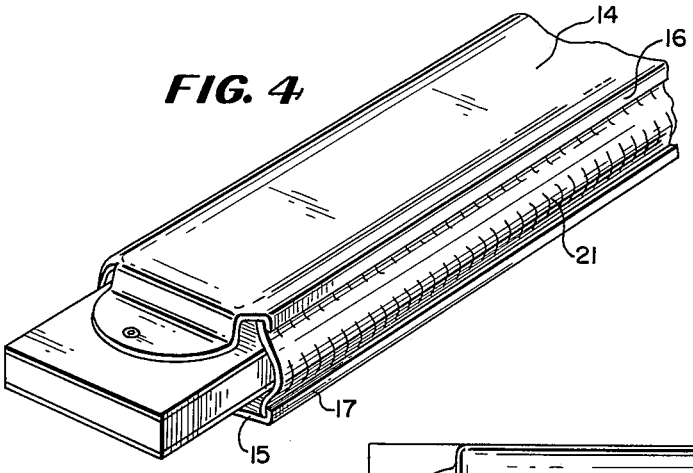
FIG. 4 is a perspective view, related to that of FIG. 1, depicting the attachment of the sound chamber portion to the metal plates of the harmonica.

FIG. 2 depicts the sound chamber and transducer apparatus of the invention. The apparatus includes a chamber member 21 made of stainless steel or other non-corrosive materials, including plastic, of substantially the same length as the harmonica body to which the apparatus is to be affixed. As better shown in FIG. 3, the member 21 includes a central convex portion 22 and a pair of outer edge portions 23, 24. These edge portions are beveled and shaped to slide within the flanges 16, 17 of the metal plates conventionally fixed to most harmonicas. When assembled the chamber member 21 is received within the flanges as shown generally in FIG. 4.

Figure 5:
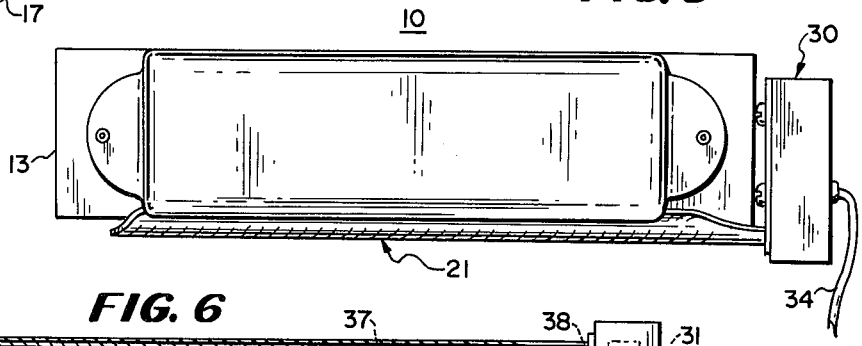
FIG. 5 is a perspective illustration of the apparatus of this invention attached to a conventional harmonica.

As shown in FIG. 2 the left end 25 of the chamber member 21 is open, and the other end 26 is bent to form an attaching portion for the chamber member. This attaching portion 26 or flange can be a separate member but it is simpler to make the entire unit 21 from a single piece of metal, deforming the portion 26 at substantially right angles to the length of the chamber member 21 to form the attaching portion 26. To the right of the chamber member 21 is a transducer assembly 30, as also visible in FIGS. 6 and 7. Within the transducer assembly body portion is a transducer element 31, which can be a conventional microphone pick-up suitable for receiving sound waves as the sound is produced in the chamber, and converting the received sound waves into an electrical signal for passage over a pair of conductors 32, 33 within the cable assembly 34. As is best shown in FIG. 5, the end of the cable assembly 34 is terminated with a conventional electrical jack or plug 35 to facilitate connection to associated amplifying apparatus (not shown) or other conventional electrical units. The entire transducer assembly is affixed to the flange 26 by a pair of screws 40, 41.

Figure 6:
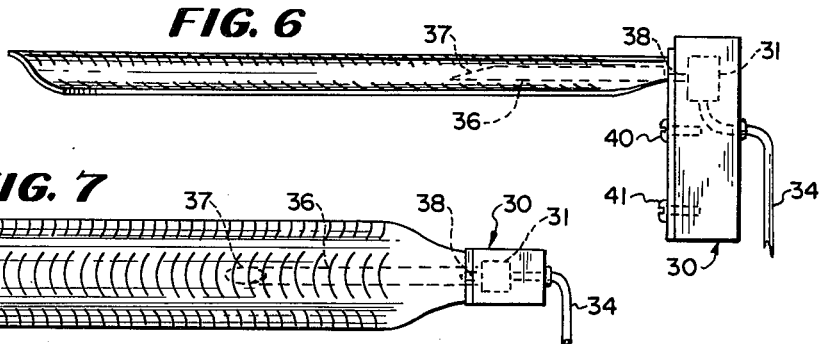
FIGS. 6 and 7 are side and top views, respectively, of the sound chamber transducer apparatus of the present invention.
Figure 7:
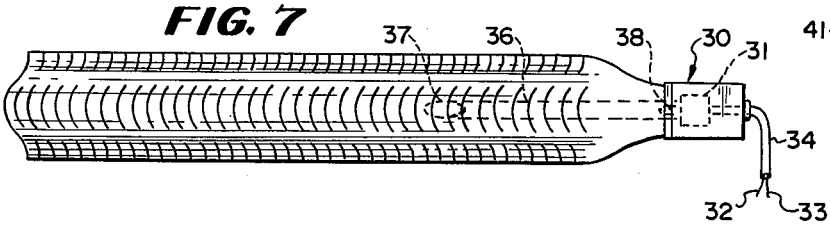

As best shown in FIGS. 6 and 7, a sound input director element 36 is provided within the chamber defined by the member 21. In a preferred embodiment the sound director element 36 is made of small plastic tube of approximately the dimensions $1\frac{3}{4}$ inches $\times$ $\frac{1}{8}$ inch indicated in the drawing. One end 37 of the director element is open to the space between the sound chamber wall 22 and the back surface 12 of the harmonica body. It is noted that this opening 37 at the end of the director element 36 is slanted, or cut on the bias, to receive the sound waves which have emanated from the harmonica and been directed around by the fluted or convex portion 22 of the chamber member. The other end 38 of the sound input director element is open and passes the sound waves to the transducer element or microphone for conversion into electrical impulses. It is believed that the positioning and configuration of the sound input director element enhances the sound pick-up and reproduction of the apparatus of this invention.

TECHNICAL ADVANTAGES

The present invention has obviated many of the difficulties encountered with the prior art harmonica amplification systems. In particular the system is compact and easily attached to the rear flanges of most conventional harmonicas. In addition there is no problem with the application of significant voltage in the area of the mouth of the user. The adapter is readily affixed by the simple sliding motion onto the rear of the harmonicas presently available on the market. In addition the sound quality of the reproduced, amplified sound is significantly better than that which has been obtained with known arrangements.

While only a particular embodiment of the invention has been described and illustrated, it is apparent that various modifications and alterations can be made therein. It is therefore the intention of the appended claims to cover all such modifications and alterations as may fall within the true spirit and scope of the invention.

What is claimed is:

1. A sound chamber and transducer apparatus for use with a reed-type harmonica having metal plates extending respectively above and below the harmonica body, comprising:

a chamber member of substantially the same length as the harmonica body, having a convex central portion and a pair of outer edge portions formed for engaging the metal plates of the harmonica, and an attaching portion at one end of the chamber member extending at substantially right angles to the chamber member;

a transducer assembly, including a body portion affixed to the attaching portion of the chamber member, and a transducer element supported within the body portion; and a generally cylindrical sound input director element, having a tapered portion at one extremity open to the space between the sound chamber convex central portion and the harmonica body, and having the other end portion adjacent the transducer element, to conduct the sound vibrations from the chamber to the transducer element.

2. A sound chamber and transducer apparatus as claimed in claim 1, and further comprising a pair of conductors in a cord assembly coupled at one end to the transducer element, and a plug coupled to the other end of the cord assembly, to facilitate passing a signal to associated apparatus.

3. A sound chamber and transducer apparatus as claimed in claim 1, in which the tapered portion of the sound input director element provides an opening toward the convex central portion of the chamber member.

4. A sound chamber and pick-up apparatus for use with a reed-type harmonica having metal plates extending respectively above and below the harmonica body, with each metal plate terminating in a flange extending at right angles to the plate, comprising:

a chamber member of substantially the same length as the harmonica body, having a convex central portion and a pair of outer edge portions formed to engage the flanges at the terminations of the harmonica metal plates, and a flange portion at one end of the chamber member extending at substantially right angles to the chamber member;

a pick-up assembly, including a body portion affixed to the flange portion of the chamber member, and a microphone pick-up element supported within the body portion;

a generally cylindrical sound input director, element, having a tapered portion at one extremity open to the space between the sound chamber convex central portion and the harmonica body, such that the tapered portion provides an opening toward the convex central portion of the chamber member, and having the other end portion adjacent the microphone pick-up; and a pair of conductors in a cord assembly coupled at one end to the microphone pick-up, and a plug coupled to the other end of the cord assembly, to facilitate passing a signal to associated apparatus.

* * * * *